US008381909B2

(12) United States Patent
Hernandez et al.

(10) Patent No.: US 8,381,909 B2
(45) Date of Patent: Feb. 26, 2013

(54) STACKABLE CADDY SYSTEM

(76) Inventors: Rolando Hernandez, Chicago, IL (US); Jacqueline Gagnon-Volles, Naperville, IL (US); Thomas Welsh, Aurora, IL (US)

( * ) Notice: Subject to any disclaimer, the term of this patent is extended or adjusted under 35 U.S.C. 154(b) by 872 days.

(21) Appl. No.: 12/408,599

(22) Filed: Mar. 20, 2009

(65) Prior Publication Data

US 2010/0236965 A1 Sep. 23, 2010

(51) Int. Cl.
*B65D 6/28* (2006.01)

(52) U.S. Cl. ..... 206/503; 206/505; 206/511; 206/669; 206/518; 206/507; 206/207; 206/419; D3/272; D3/302; D9/424; 220/22.3

(58) Field of Classification Search ..... 206/505, 206/503, 349, 373, 419; D3/272, 302; D7/605
See application file for complete search history.

(56) References Cited

U.S. PATENT DOCUMENTS 3,117,692 A * 1/1964 Carpenter et al. ..... 206/508
4,441,615 A * 4/1984 Goodrich ..... 206/511
2010/0224528 A1* 9/2010 Madsen ..... 206/505

OTHER PUBLICATIONS

Small 4 Layer Square with One Divided Tray: Snapware (htt://www.snapware.com/W-60884018.html).

* cited by examiner

*Primary Examiner* — Anthony Stashick
*Assistant Examiner* — Cynthia Collado
(74) *Attorney, Agent, or Firm* — Neal, Gerber & Eisenberg LLP

(57) ABSTRACT

A tray system is described herein comprising a plurality of trays. Each of the trays comprise generally increasing widths and lengths, and may be alternatively arranged in a stacked configuration, in which a tray with a larger width and length is stacked on a tray with a smaller width and length, or in a nested configuration, in which a tray with a smaller width and length is nested within a tray with a larger width and length. The trays further comprise latches that selectively lock the trays in the stacked configuration and prevent the accidental unlocking thereof when the stacked trays are being lifted or otherwise moved.

13 Claims, 5 Drawing Sheets

STACKABLE CADDY SYSTEM

BACKGROUND OF THE INVENTION

This application is related to a stackable tray caddy system that is lockable when lifted.

SUMMARY OF THE INVENTION

The present invention provides a tray caddy system that is stackable. The present invention further provides a locking feature that allows the trays to lock when picked up.

A better understanding of the objects, advantages, features, properties and relationships of the invention will be obtained from the following detailed description and accompanying drawings which set forth illustrative embodiments and are indicative of the various ways in which the principles of the invention may be employed.

DETAILED DESCRIPTION OF THE DRAWINGS

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

Figure 1:
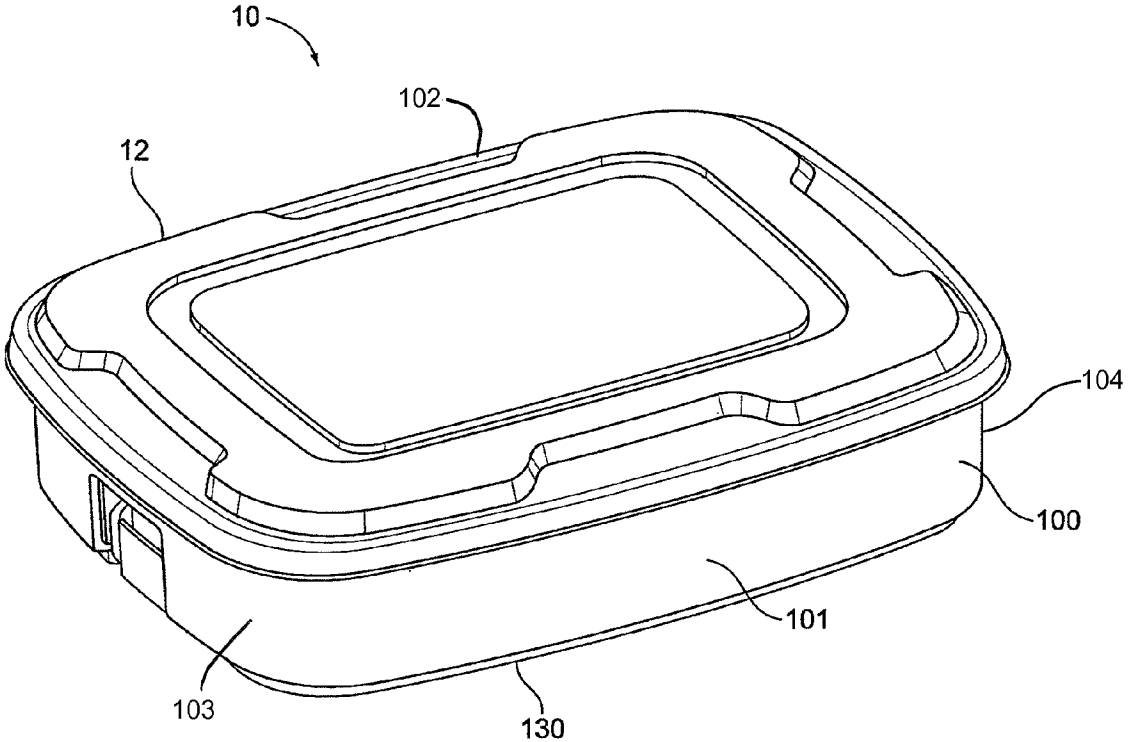
FIG. 1 is an isometric view of a first embodiment of the present invention, in the nested configuration.
Figure 2:
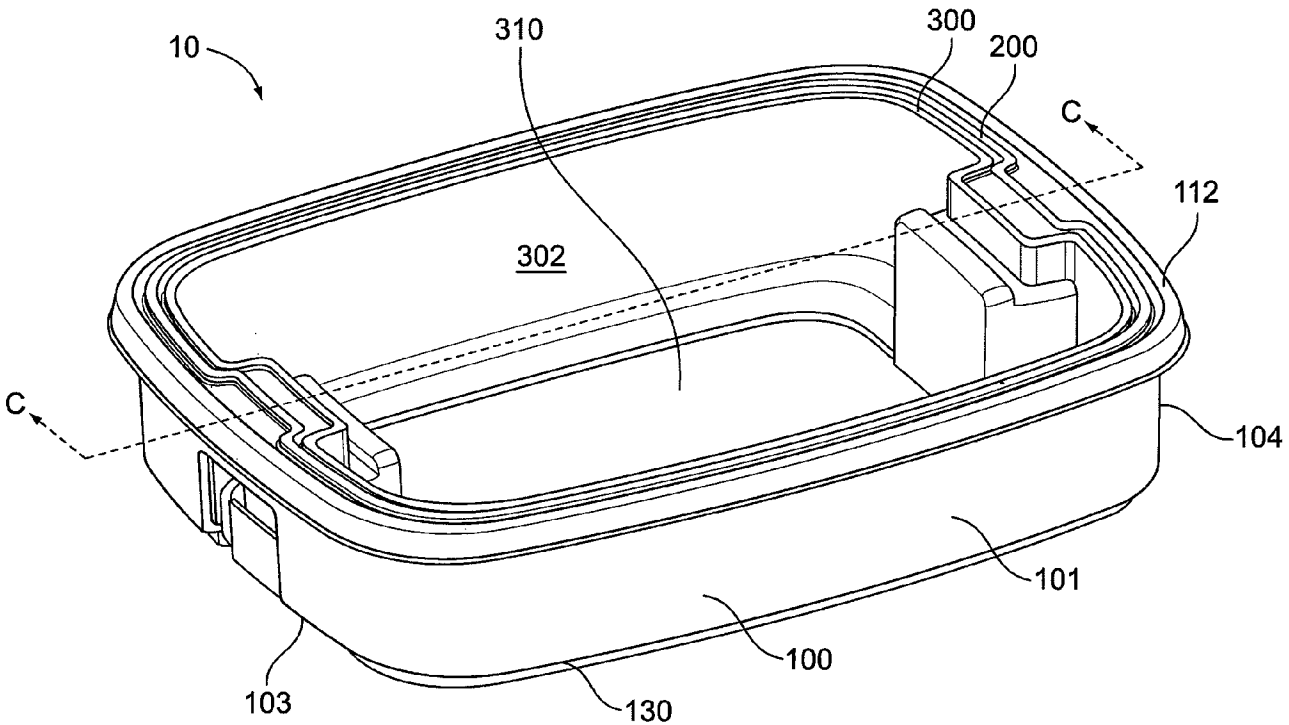
FIG. 2 is the view of FIG. 1, with the lid removed.

A first embodiment of stackable caddy system 10 is shown in FIG. 1 and FIG. 2. These figures depict stackable caddy system 10 in the first, nested configuration. FIG. 2 depicts stackable caddy system 10 with lid 12 removed for clarity. The first embodiment of caddy system 10 comprises three stackable trays: tray 100, tray 200 and tray 300. Each tray is of varying size, with tray 100 being the largest and tray 300 being the smallest. However, as described in detail below, each tray has similar features.

It will be recognized by those in the art that the scope of the present invention comprises both more and less stackable trays, and the depicted embodiment is meant to be illustrative only. By way of example, caddy system 10 may comprise as little as two trays. Caddy system 10 may also comprise more than three trays. It will further be recognized by those in the art that if caddy system 10 comprises more than three trays, it must have a tray that is the equivalent of tray 100 (i.e., can serve as the base tray when the system is in the nested configuration) and it must have a tray that is the equivalent of tray 300 (i.e., it can serve as the base tray when the system is in the stacked configuration). The number of trays between these two is immaterial.

As best seen in FIG. 2, caddy system 10 may comprise a first configuration, in which each tray 100, 200 and 300 of caddy system 10 is nested. In this configuration, tray 100 serves as a base tray, and tray 200 is nested in tray 100, and tray 300 is nested in tray 200. Also, as seen, in the nested configuration, tops 112, 212 and 312 of the respective trays are all at the same height.

Caddy system 10 may further comprise a second configuration, described in detail below, in which each tray 100, 200 and 300 of caddy system 10 is stacked. In this configuration, tray 300 serves as the base tray, tray 200 is stacked on top of tray 300, and tray 100 is stacked on top of tray 200. In other words, in the nested configuration, the trays are engaged largest to smallest, while in the stacked configuration, the trays are engaged smallest to largest.

In the depicted embodiment, tray 100 comprises a first wall 101 and a second wall 102, disposed opposite to first wall 101. Tray 100 further comprises third wall 103, disposed perpendicular to first and second walls 101 and 102, and fourth wall 104, which is disposed opposite third wall 103. Tray 100 further comprises floor 105. Walls 101, 102, 103 and 104, together with floor 105, define interior 110, which, as seen in FIG. 2, is where trays 200 and 300 are stored when caddy system 10 is in the nested configuration.

Tray 100 further comprises top securing structure 112, which is adapted to releasably secure lid 12 to caddy system 10. In the depicted embodiment, top securing structure 112 comprises a lip formed on the top of walls 101, 102, 103 and 104, and lid 12 is releasably secured to caddy system 10 through a snap-fit arrangement. However, it will be appreciated that lid 12 may be releasably secured though any mating structures, such as buttons, a tongue-in-groove arrangement, a latching system, etc., and top securing structure 112 may be any structure that allows for such a corresponding structure.

Figure 3:
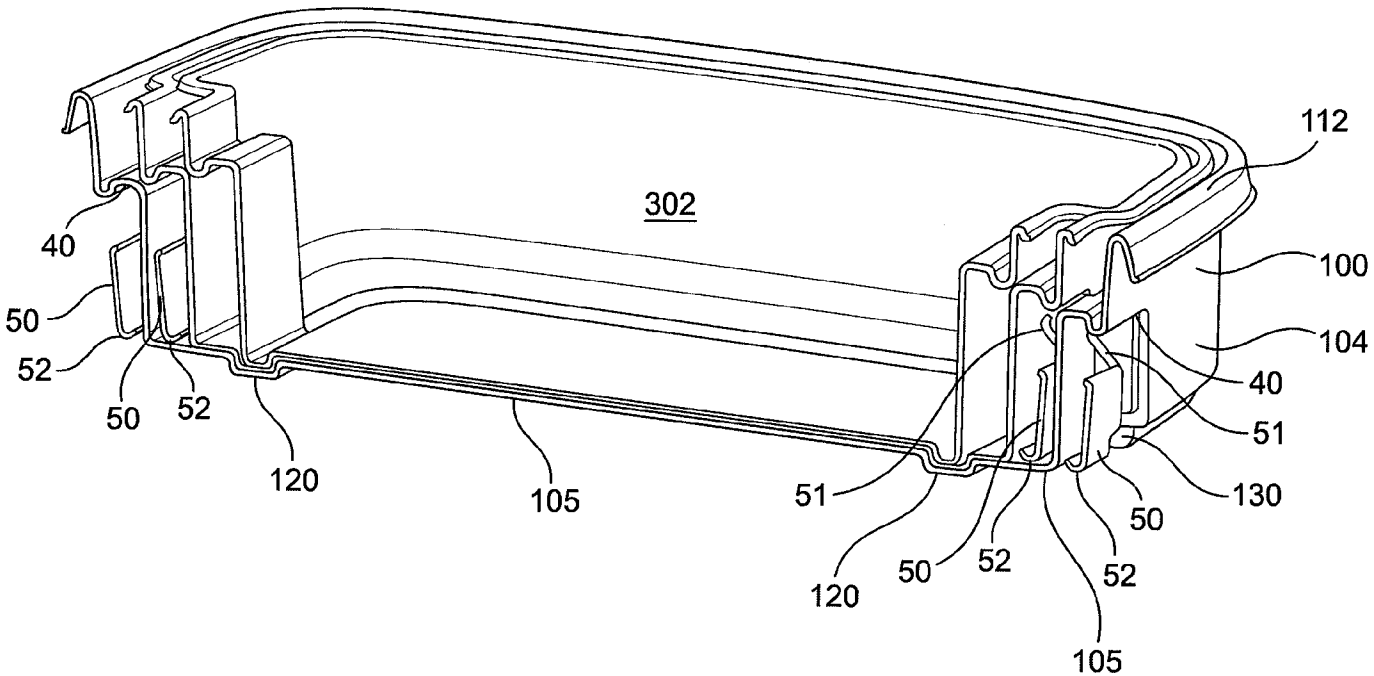
FIG. 3 is a cut away view along the lines C-C of the embodiment in FIG. 2.

To provide a base on which caddy system 10 may rest when it is in the nested configuration, floor 105 may further comprise foot 120, which is integrally formed from floor 105. As further seen in FIG. 4, foot 120 provides a groove 122 formed in floor 105. As seen in FIG. 3, groove 122 aides in locating and securing tray 200 in tray 100 when caddy system 10 is in the nested configuration. Specifically, groove 122 cooperates with foot 220 formed on floor 205 of tray 200. In this manner, tray 200 is located within interior 110. Moreover, once located, the interaction of groove 122 with foot 220 helps to prevent tray 200 from sliding within interior 110 if tray 100 is tilted.

To aid in positioning tray 100 on tray 200 when caddy system 10 is in the stacked configuration, tray 100 may further comprise bottom positioning structure 130. In the depicted embodiment, bottom positioning structure 130 comprises a lip formed on the bottom of walls 101, 102, 103 and 104. In the stacked configuration, bottom positioning structure 130 cooperates with top securing structure 212, formed on tray 200, to correctly position tray 100 on tray 200. Top securing structure 212 and bottom positioning structure 130 may further cooperate to help secure tray 100 to tray 200 if caddy system 10 is tilted.

To provide a user with a location to easily grasp and lift or move caddy system 10, tray 100 may further comprise at least one handle 40. In the depicted embodiment, a handle 40 is formed on wall 103 and wall 104 of tray 100. However, it will be understood by those in the art that the scope of the present invention includes those embodiments in which tray 100 comprises only one handle 40, as well as those embodiments in which tray 100 comprises more than two handles 40, which may be formed on any or all of walls 101, 102, 103 or 104.

Trays 200 and 300 comprise many structural components similar to tray 100. By way of example, and in no way limiting, tray 200 comprises a first wall 201, and a second wall 202, formed opposite to first wall 201. Tray 200 further comprises third wall 203, formed perpendicular to first and second walls 201 and 202, and fourth wall 204, formed opposite third wall 203. Tray 200 further comprises floor 205. Walls 201, 202, 203 and 204, together with floor 205, define interior 210, which, as seen in FIG. 2, is where tray 300 is stored when caddy system 10 is in the nested configuration.

Tray 200 further comprises top securing structure 212. In the depicted embodiment, top securing structure 212 is a lip formed on the top of walls 201, 202, 203 and 204, which is adapted to locate and secure tray 100 when caddy system is in the stacked configuration. Top securing structure 212 also provides a location that allows latches 50 to lock when caddy system 10 is lifted, as discussed further below.

Floor 205 may further comprise foot 220, which is integrally formed from floor 205. As further seen in FIG. 4, foot 220 provides a groove 222 formed in floor 205. As noted above, foot 220 aides in locating and securing tray 200 in tray 100 when caddy system 10 is in the nested configuration. As seen in FIG. 3, groove 222 also aides in locating and securing tray 300 in tray 200 when caddy system 10 is in the nested configuration. Specifically, groove 222 cooperates with foot 320 formed on floor 305 of tray 300 to properly position tray 300 inside tray 200. Moreover, once positioned, the interaction of groove 222 with foot 320 helps to prevent tray 300 from sliding within interior 210 if tray 100 or tray 200 is tilted.

To aide in positioning tray 200 on tray 300 when caddy system 10 is in the stacked configuration, tray 200 may further comprise bottom positioning structure 230. In the depicted embodiment, bottom positioning structure 230 comprises a lip formed on the bottom of walls 201, 202, 203 and 204. In the stacked configuration, bottom positioning structure 230 cooperates with top securing structure 312, formed on tray 300, to correctly position tray 200 on tray 300. Top securing structure 312 and bottom positioning structure 230 may further cooperate to help secure tray 200 to tray 300 if caddy system 10 is tilted.

To provide a user with a location to easily grasp and lift or move caddy system 10, tray 200 may further comprise at least one handle 40. In the depicted embodiment, a handle 40 is formed on wall 203 and wall 204 of tray 200. However, it will be understood by those in the art that the scope of the present invention includes those embodiments in which tray 200 comprises only one handle 40, as well as those embodiments in which tray 200 comprises more than two handles 40, which may be formed on any or all of walls 201, 202, 203 or 204.

Like tray 200 and tray 100, tray 300 may comprise a first wall 301, and a second wall 302, formed opposite to first wall 301. Tray 300 further comprises third wall 303, formed perpendicular to first and second walls 301 and 302, and fourth wall 304, formed opposite third wall 303. Tray 300 further comprises floor 305. Walls 301, 302, 303 and 304, together with floor 305, define interior 310.

As seen, in the nested configuration, tray 300 has no trays configured in it. As such, Tray 300 may comprise numerous compartments molded or otherwise disposed in interior 310. Likewise, trays 100 and 200 may also comprise numerous compartments in their respective interiors, although it will be appreciated that any compartments in trays 100 or 200 will be removable, or otherwise allow for a tray to be nested in interiors 110 and 210 respectively.

Tray 300 further comprises top securing structure 312. In the depicted embodiment, top securing structure 312 is a lip formed on the top of walls 301, 302, 303 and 304, which is adapted to locate and secure tray 200 when caddy system is in the stacked configuration. Top securing structure 312 also provides a location that allows latches 50 to lock when caddy system 10 is lifted, as discussed further below.

Floor 305 may further comprise foot 320, which is integrally formed from floor 305. When in the stacked configuration, foot 320 provides a base on which caddy system 10 rests. Furthermore, as seen in FIG. 3, foot 320 aides in locating and securing tray 300 in tray 200 when caddy system 10 is in the nested configuration. Specifically, foot 320 cooperates with groove 222 formed on floor 205 of tray 200. In this manner, tray 300 is located within interior 210. Moreover, once located, the interaction of groove 222 with foot 320 prevents tray 300 from sliding within interior 210 if tray 200 is tilted.

To provide a user with a location to easily grasp and lift or move caddy system 10, tray 300 may further comprise at least one handle 40. In the depicted embodiment, a handle 40 is formed on wall 303 and wall 304 of tray 100. However, it will be understood by those in the art that the scope of the present invention includes those embodiments in which tray 300 comprises only one handle 40, as well as those embodiments in which tray 300 comprises more than two handles 40, which may be formed on any or all of walls 301, 302, 303 or 304.

In the stacked configuration, trays 100 and 200 are releasably secured to one another, while trays 200 and 300 are likewise releasably secured to one another. To provide for this, tray 100 and tray 200 further comprises latches 50. In the depicted embodiment, latches 50 are located proximate to handles 40. However, it will be appreciated by those in the art that latches 50 may be located elsewhere on tray 100 or tray 200. Likewise, while the depicted embodiment shows a latch 50 engaged to tray 100 and tray 200, it will be appreciated that some or all of latches 50 may be integrally formed with their respective trays.

Each latch 50 is movable between a locked position and an open position. In the depicted embodiment, each latch 50 comprises a spring 51, which biases latch 50 to the locked position. As seen, spring 51 is integrally formed with latch 50, but it will be appreciated that spring 51 may be a separate spring, or any element that provides a biasing force to latch 50. To move latch 50 to the open position, a user may depress the top of latch 50, moving it toward its respective wall. Releasing pressure from the top of latch 50 will allow spring 51 to move latch 50 back to the locked position. It will be appreciated by those in the art, however, that there are numerous ways to move latch 50 between its open and closed position without departing from the present invention.

Latch 50 further comprises a locking component 52 formed on the bottom of latch 50. When caddy system 10 is in the stacked configuration, each locking component 52 cooperates with a locking featured formed on the tray that is immediately below the latch 50. By way of example, the locking components 52 on latches 50 engaged to tray 100 cooperate with a locking feature formed on tray 200 to releasably secure tray 100 to tray 200. In the depicted embodiment, the locking feature for each of the latches 50 is top securing structures 212 and 312, respectively. However, it will be appreciated by those in the art that any other locking feature may be formed on the trays to help locking components 52 secure the trays to their immediately proximate trays. In the depicted embodiment, the top securing structures 212 and 312 extend at about a 45 degree angle from their respective trays 200 and 300. This allows the latch to make a "clicking"

noise to indicate that its respective tray is secured. For example, when tray 100 is engaged to tray 200, latches 50 on tray 100 will slide along top securing structure 212 until tray 100 is fully in position. When this happens, latches 50 will no longer be in contact with top securing structure 212, and springs 51 will snap latches 50 back into place, creating a "clicking" noise.

Figure 4:
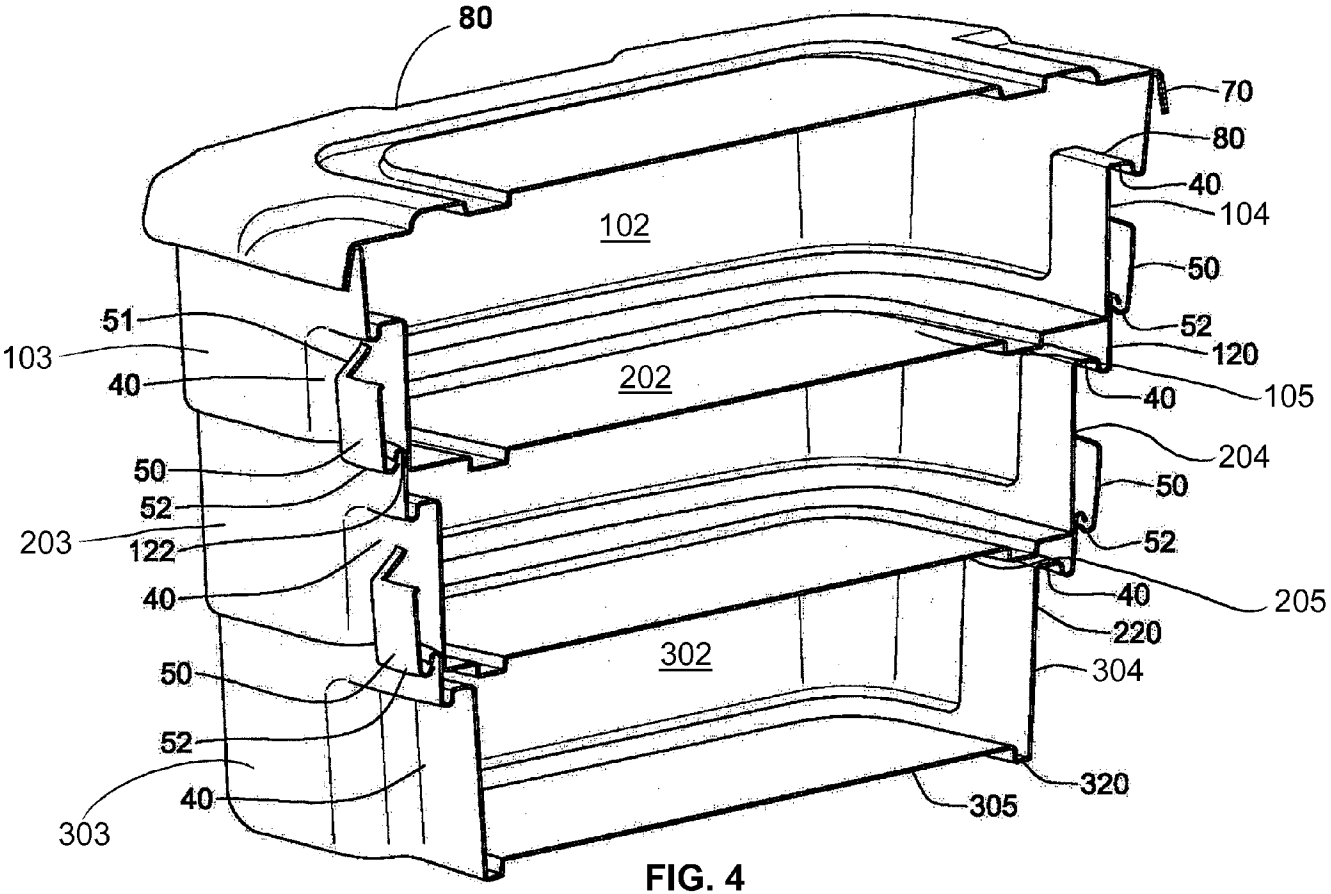
FIG. 4 is a cut away view along the lines D-D of the embodiment in FIG. 5.
Figure 5:
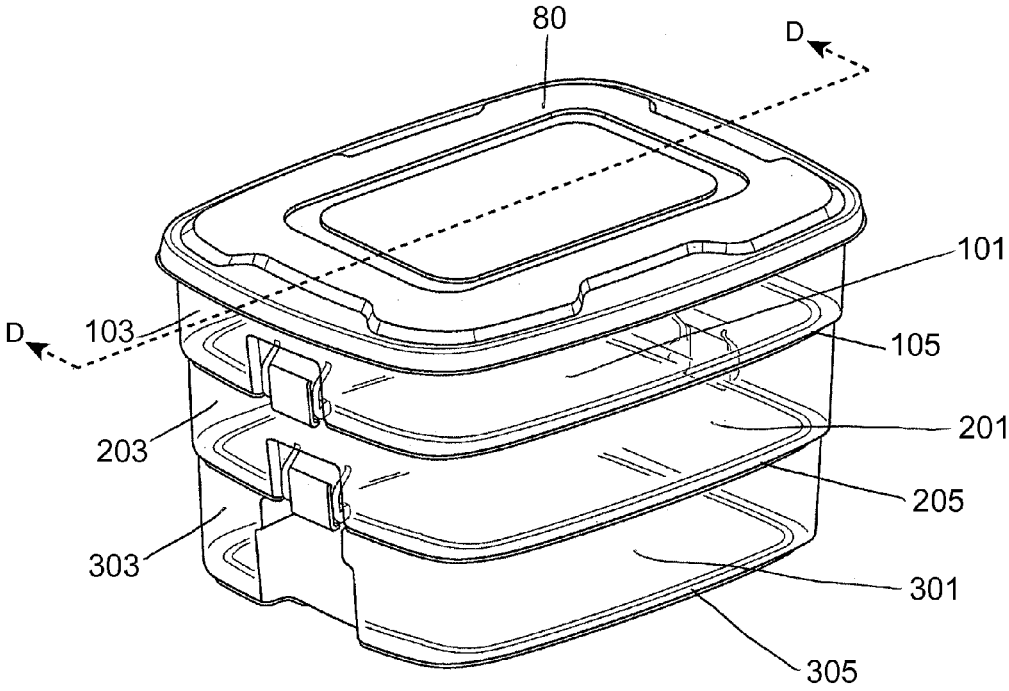
FIG. 5 is an isometric view of a first embodiment of the present invention, in the stacked configuration.

As seen in FIG. 4, a gap exists between locking components 52 and their respective locking features. Specifically, a gap exists between locking components 52 on tray 100 and top securing structure 212. A gap further also exists between locking components 52 on tray 200 and top securing structure 312. In this manner, latches 50 can easily move between their respective locked and open positions when caddy system is in the stacked configuration.

Moreover, these gaps allows the latches to lock when caddy system 10 is lifted, thus preventing any inadvertent unlocking of latches 50 while in use. Specifically, if a user lifts the stacked caddy system 10 from handles 40 formed on tray 100, the latches 50 will rise, engaging top securing structure 212, thus preventing the latches 50 on tray 100 from moving to the open position. As the user lifts tray 100, tray 200 will also rise, causing handles 40 formed on tray 200 to engage top securing structure 312, thus preventing the latches 50 on tray 200 from moving to the open position.

Additionally, if a user wishes to remove one or two trays from the stacked configuration, latches 50 allow him to do so. For example, if a user wishes to only remove tray 100 from the stacked configuration, he can move the latches 50 on tray 100 to the open position, then lift tray 100 at the handles 40 formed on tray 100. In this manner, tray 100 will be lifted, while trays 200 and 300 will remain.

Caddy system 10 further comprises lid 12. As seen, lid 12 is configured to be removably secured to tray 100. By way of example, lid 12 has a first securing structure 70 formed on the periphery thereof. In the depicted embodiment, first securing structure 70 snap fits onto top securing structure 112, however, any known means of releasably securing lid 12 to tray 100 may be employed. Lid 12 further comprises groove 80 formed thereon. Groove 80 corresponds to foot 120, foot 220 and foot 320. In this manner, a first caddy system 10 may be stacked on top of a second caddy system 10, for example, in a storage, shipping or display situation.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A tray system comprising:

a plurality of trays, wherein the trays comprise various, generally increasing widths and lengths, and may be alternatively arranged in a stacked configuration, in which a tray with a larger width and length is stacked on a tray with a smaller width and length, or in a nested configuration, in which a tray with a smaller width and length is nested within a tray with a larger width and length, each of the trays further comprising:

a width and a length;

a first wall, a second wall disposed opposite the first wall, a third wall and a fourth wall disposed opposite the third wall;

a floor engaged to each of the walls;

a foot extending from the floor, wherein the foot creates a groove on the floor;

a top securing structure engaged to at least one of the walls;

a bottom positioning structure engaged to at least one of the walls; and at least one latch movable between an unlocked and a locked position and disposed on at least one of the trays, the at least one latch comprising:

a spring biasing the at least one latch to the locked position;

a locking component formed on one end of the latch, wherein the locking component is selectively engageable to one of the top securing structures;

wherein a gap is formed between the at least one latch and the one of the top securing structures when the plurality of trays are resting in the stacked configuration, and wherein the at least one latch directly engages the one of the top securing structures when the plurality of trays are in the stacked configuration and being lifted; and a plurality of latches, wherein all but one of the trays comprises at least one latch.

2. A tray system comprising:

a plurality of trays, wherein the trays comprise various, generally increasing widths and lengths, and may be alternatively arranged in a stacked configuration, in which a tray with a larger width and length is stacked on a tray with a smaller width and length, or in a nested configuration, in which a tray with a smaller width and length is nested within a tray with a larger width and length, each of the trays further comprising:

a width and a length;

a first wall, a second wall disposed opposite the first wall, a third wall and a fourth wall disposed opposite the third wall;

a floor engaged to each of the walls;

a foot extending from the floor, wherein the foot creates a groove on the floor;

a top securing structure engaged to at least one of the walls;

a bottom positioning structure engaged to at least one of the walls; and at least one latch movable between an unlocked and a locked position and disposed on at least one of the trays, the at least one latch comprising:

a spring biasing the at least one latch to the locked position;

a locking component formed on one end of the latch, wherein the locking component is selectively engageable to one of the top securing structures;

wherein a gap is formed between the at least one latch and the one of the top securing structures when the plurality of trays are resting in the stacked configuration, and wherein the at least one latch directly engages the one of the top securing structures when the plurality of trays are in the stacked configuration and being lifted;

a plurality of latches, wherein all but one of the trays comprises at least one latch; and a plurality of handles, wherein each tray comprises at least one handle, and the latches are disposed proximate to the handles.

3. A tray system comprising:

a first tray comprising:

a first width and a first length;

a first wall, a second wall disposed opposite the first wall, a third wall and a fourth wall disposed opposite the third wall;

a first floor engaged to each of the walls;

a first foot extending from the first floor, wherein the first foot creates a first groove on the first floor;

a first top securing structure engaged to the tops of the walls of the first tray;

a first bottom positioning structure engaged to the bottoms of the walls of the first tray;

a first handle located on the first wall;

a second handle located on the second wall;

a first latch movable between an unlocked position and a locked position and located proximate to the first handle; and a second latch movable between an unlocked position and a locked position and located proximate to the second handle;

a second tray comprising:

a second width, shorter than the first width, and a second length, shorter than that first length;

a fifth wall, a sixth wall disposed opposite the fifth wall, a seventh wall and an eighth wall disposed opposite the seventh wall;

a second floor engaged to each of the walls of the second tray;

a second foot extending from the second floor, wherein the second foot creates a second groove on the second floor;

a second top securing structure engaged to the tops of the walls of the second tray;

a second bottom positioning structure engaged to the bottoms of the walls of the second tray;

a third handle located on the fifth wall;

a fourth handle located on the sixth wall;

a third latch moveable between an unlocked position and a locked position and located proximate to the third handle; and a fourth latch movable between an unlocked position and a locked position and located proximate to the fourth handle;

a third tray comprising:

a third width, shorter than the second width, and a third length, shorter than that second length;

a ninth wall, a tenth wall disposed opposite the ninth wall, an eleventh wall and a twelfth wall disposed opposite the eleventh wall;

a third floor engaged to each of the walls of the third tray;

a third foot extending from the third floor, wherein the third foot creates a third groove on the third floor;

a third top securing structure engaged to the tops of the walls of the third tray;

a third bottom positioning structure engaged to the bottoms of the walls of the third tray;

a fifth handle located on the ninth wall; and a sixth handle located on the tenth wall; and a lid removably secured to the first top securing structure;

wherein the first, second and third trays may be alternatively arranged in a stacked configuration, in which the first tray is stacked upon the second tray which is then stacked upon the third tray, or a nested configuration, in which the third tray is nested within the second tray which is then nested within the first tray; and wherein the first and the second latches are selectively engageable to the second top securing structure when the trays are in the stacked configuration, and the third and fourth latches are selectively engageable to the third top securing structure when the trays are in the stacked configuration; and wherein a gap is formed between each of the latches and their respective top securing structures when the trays are resting in the stacked configuration, and wherein each of the latches are engaged to their respective top securing structures when the trays are in the stacked configuration and lifted.

4. The tray system as set forth in claim 3, wherein the top securing structures extend from their respective trays at a 45 degree angle.

5. The tray system as set forth in claim 3, wherein the third foot engages the second groove, and the second foot engages the first groove when the trays are in the nested configuration.

6. The tray system as set forth in claim 3, wherein the first, the second and the third top securing structures are coplanar when the trays are in the nested configuration.

7. The tray system as set forth in claim 3, wherein the first bottom positioning structure engages the second top securing structure and the second bottom positioning structure engages the third top securing structure when the trays are in the stacked configuration.

8. The tray system as set forth in claim 3, further comprising a lid groove formed on the lid, wherein the lid groove may engage any of the first foot, the second foot or the third foot.

9. The tray system as set forth in claim 3, wherein the first and the second latches are integrally formed with the first tray.

10. The tray system as set forth in claim 3, further comprising a first spring engaged to the first latch, a second spring engaged to the second latch, a third spring engaged to the third latch and a fourth spring engaged to the fourth latch, wherein each spring biases its respective latch to the locked position.

11. The tray system as set forth in claim 10, wherein each spring is integrally formed from its respective latch.

12. A tray system comprising:

a first tray comprising:

a first width and a first length;

a first wall, a second wall disposed opposite the first wall, a third wall and a fourth wall disposed opposite the third wall;

a first floor engaged to each of the. walls;

a first foot extending from the first floor, wherein the first foot creates a first groove on the first floor;

a first top securing structure engaged to the tops of the walls of the first tray;

a first bottom positioning structure engaged to the bottoms of the walls of the first tray;

a first handle located on the first wall;

a second handle located on the second wall;

a first latch movable between an unlocked position and a locked position and located proximate to the first handle; and a second latch movable between an unlocked position and a locked position and located proximate to the second handle;

a second tray comprising:

a second width, shorter than the first width, and a second length, shorter than that first length;

a fifth wall, a sixth wall disposed opposite the fifth wall, a seventh wall and an eighth wall disposed opposite the seventh wall;

a second floor engaged to each of the walls of the second tray;

a second foot extending from the second floor, wherein the second foot creates a second groove on the second floor;

a second top securing structure engaged to the tops of the walls of the second tray;

a second bottom positioning structure engaged to the bottoms of the walls of the second tray;

a third handle located on the fifth wall;

a fourth handle located on the sixth wall; and a lid removably secured to the first top securing structure;

wherein the first and second trays may be alternatively arranged in a stacked configuration, in which the first tray is stacked upon the second tray, or a nested configuration, in which the second tray is nested within the first tray;

wherein the first and the second latches selectively secure the first tray to the second tray.

13. The tray system as set forth in claim 12, further comprising:

a third tray comprising:

a third width, shorter than the first width and longer than the second width, and a third length, shorter than that first length and longer than the second length;

a ninth wall, a tenth wall disposed opposite the ninth wall, an eleventh wall and a twelfth wall disposed opposite the eleventh wall;

a third floor engaged to each of the walls of the third tray;

a third foot extending from the third floor, wherein the third foot creates a third groove on the third floor;

a third top securing structure engaged to the tops of the walls of the third tray;

a third bottom positioning structure engaged to the bottoms of the walls of the third tray;

a fifth handle located on the ninth wall;

a sixth handle located on the tenth wall;

a third latch moveable between an unlocked position and a locked position and located proximate to the third handle; and a fourth latch moveable between an unlocked position and a locked position and located proximate to the fourth handle;

wherein the first, second and third trays may be alternatively arranged in a stacked configuration, in which the first tray is stacked upon the third tray which is then stacked upon the second tray, or a nested configuration, in which the second tray is nested within the third tray which is then nested within the first tray;

wherein the first and the second latches are selectively engageable to the third top securing structure when the trays are in the stacked configuration, and the third and fourth latches are selectively engageable to the second top securing structure when the trays are in the stacked configuration; and wherein a gap is formed between each of the latches and their respective top securing structures when the trays are resting in the stacked configuration, and wherein each of the latches are engaged to their respective top securing structures when the trays are in the stacked configuration and lifted.

* * * * *